US009156593B2

(12) United States Patent
Schreiter et al.

(10) Patent No.: US 9,156,593 B2
(45) Date of Patent: Oct. 13, 2015

(54) CLOSURE ARRANGEMENTS FOR RECLOSEABLE POUCHES; RECLOSEABLE POUCHES; AND, METHODS

(71) Applicant: Reynolds Presto Products Inc., Richmond, VA (US)

(72) Inventors: Mike Schreiter, Appleton, WI (US); Todd Robbins, Iola, WI (US)

(73) Assignee: Reynolds Presto Products Inc., Lake Forest, IL (US)

( * ) Notice: Subject to any disclaimer, the term of this patent is extended or adjusted under 35 U.S.C. 154(b) by 145 days.

(21) Appl. No.: 13/837,085

(22) Filed: Mar. 15, 2013

(65) Prior Publication Data

US 2014/0270587 A1 Sep. 18, 2014

(51) Int. Cl.

| | |
|---|---|
| ***B65D 33/16*** | (2006.01) |
| ***B65D 33/25*** | (2006.01) |
| ***B31B 19/74*** | (2006.01) |

(52) U.S. Cl.

CPC ..... *B65D 33/255* (2013.01); *B31B 19/74* (2013.01); *B31B 2219/9016* (2013.01)

(58) Field of Classification Search

CPC ..... B65D 33/2508; B65D 33/255; B65D 33/2541; A44B 19/16; B29C 43/222; B29C 47/0033

USPC ..... 383/63, 61.2; 24/399, 400, DIG. 39, 24/DIG. 40

See application file for complete search history.

(56) References Cited

U.S. PATENT DOCUMENTS

| | | | | |
|---|---|---|---|---|
| 5,070,584 | A | 12/1991 | Dais et al. | |
| 5,140,727 | A | 8/1992 | Dais et al. | |
| 5,307,552 | A | 5/1994 | Dais et al. | |
| 5,478,228 | A | 12/1995 | Dais et al. | |
| 5,647,100 | A | 7/1997 | Porchia et al. | |
| 5,722,128 | A | 3/1998 | Toney et al. | |
| 6,021,557 | A | 2/2000 | Dais et al. | |
| 6,371,644 | B1 | 4/2002 | Forman | |
| 6,519,918 | B2 | 2/2003 | Forman et al. | |
| 6,523,325 | B1 | 2/2003 | Forman et al. | |
| 6,592,260 | B1 | 7/2003 | Randall et al. | |
| 6,594,872 | B2 | 7/2003 | Cisek | |
| 6,786,712 | B2 | 9/2004 | Cisek | |
| 6,896,950 | B2 | 5/2005 | Forman et al. | |
| 6,953,542 | B2 | 10/2005 | Cisek | |
| 7,017,240 | B2 | 3/2006 | Savicki | |
| 7,137,736 | B2 | 11/2006 | Pawloski et al. | |
| 7,340,807 | B2 | 3/2008 | Dais et al. | |
| 7,651,271 | B2 | 1/2010 | Withers | |
| 7,850,368 | B2 | 12/2010 | Pawloski et al. | |
| 8,469,593 | B2 * | 6/2013 | Price et al. | 383/63 |
| 8,568,031 | B2 * | 10/2013 | Price et al. | 383/63 |
| 2012/0106874 | A1 | 5/2012 | Pawloski | |
| 2012/0106875 | A1 | 5/2012 | Pawloski | |
| 2012/0106876 | A1 | 5/2012 | Pawloski | |

FOREIGN PATENT DOCUMENTS

| | | | | |
|---|---|---|---|---|
| EP | 510797 | A1 * | 10/1992 | A44B 19/16 |

* cited by examiner

*Primary Examiner* — Jes F Pascua

(74) *Attorney, Agent, or Firm* — Merchant & Gould P.C.

(57) ABSTRACT

Reclosable zipper arrangements for bags such as thermoplastic bags are described. The reclosable zipper arrangements are configured to advantageously provide a clicking sensory indicator, in the form of a tactile and/or audible indication of sealing, as zipper closure occurs. Package arrangements using the closure arrangements are described. Also, methods of assembly and use are described.

31 Claims, 5 Drawing Sheets

CLOSURE ARRANGEMENTS FOR RECLOSEABLE POUCHES; RECLOSEABLE POUCHES; AND, METHODS

FIELD OF THE DISCLOSURE

The present disclosure relates to reclosable pouches, such as reclosable thermoplastic bags, that are closed with reclosable zipper arrangements. The disclosure particularly concerns such arrangements in which the reclosable zipper arrangements are configured for a clicking sensory (audible and/or tactile) indication of closure seal or lock. Closure arrangements for use in the development of such pouches; and, methods of assembly and use are described.

BACKGROUND

Reclosable closure or seal arrangements for pouches such as thermoplastic bags are well known. They are sometimes referenced as zipper closures or zipper locks. Many are operated by hand or finger pressure pressing a first side or member of an elongate plastic zipper closure arrangement against an opposite second side member of the plastic zipper closure arrangement. Often it is desirable to provide such arrangements in which there is a clicking sensory (audible and/or touch) indication of locking (or sealing) engagement between two zipper side members during closure.

In many applications, the closure arrangements are reclosable thermoplastic bags and each side of the closure arrangement is configured with two elongate locking zipper sections (or double elongate closure) adjacent one another in the bag. The two elongate locking zipper sections may be configured identical to one another, but often are provided structurally different from one another. For example, one may be configured to provide for the clicking sensory (audible and/or touch) locking or sealing indicator, while the other is configured to provides a strong closure lock and seal. Also, sometimes the two zipper sections are configured inverted relative to one another, with respect to direction of male member and female member projection.

In arrangements that use a double elongate closure arrangement, typically the two are sufficiently adjacent one another so as to be conveniently operable by a user upon a single finger width pressure during actuation.

In general, it is desirable to provide closure arrangements and resulting bags in manners that are convenient for assembly and use and which provide unambiguous indication of secure closure. Improvements have been sought.

SUMMARY

According to the present disclosure, reclosable zipper closure arrangements are provided. The arrangements are useable, for example, in a reclosable plastic bag, such as a thermoplastic bag. The zipper closure arrangement comprises a first, elongate, base strip having a front side and an opposite back side. A continuous, elongate, first male member is positioned on the first elongate base strip, at a location projecting from the front side.

The continuous, elongate, first male member comprises a clicking sensory indicator male strip. Herein, the term "clicking sensory" when used in connection with defining a zipper closure arrangement, is meant to refer to a closure arrangement that is configured to provide an indication of a proper engagement or sealing by a repeated clicking sensation achieved as longitudinal closure occurs. The clicking sensation or indication can be provided audibly (by sound) or by touch (tactile) sense or both. The term "clicking sensory" in and of itself is not meant to include within its scope, arrangements that merely indicate sealing by color change. Rather, the term "clicking" is meant to specifically reference an arrangement configured to repeatedly click or bump (touch and/or feel) as the closure occurs.

When it is said that the continued elongate first male member comprises a clicking sensory indicator male strip, it is meant to be indicated that the male strip is configured in a manner that will provide the repeated clicking action, when it is used in association with an appropriate female member, during closure of the zipper arrangement. An example modification is described, in which the male strip comprises alternating first and second sections that will engage (or be engaged by) the female member differently.

Typically and preferably, the continuous elongate first male member has a central rib with a continuous peak. Preferably the continuous peak has a cross-sectional height H in extension from the back side, that does not vary by any more than 0.22 mm, typically no more than 0.2 mm, along the length of extension of at least 4 cm, often of at least 6 cm, not including any end distortion that may occur at ends of the strip or male member. Most preferably, the continuous peak has a cross-sectional height H, in extension from the back side, that does not vary any more than 0.15 mm, often no more than 0.1 mm and in some instances no more than 0.08 mm, along the length of extension of at least 4 cm, often at least 6 cm, not including any end distortion that may occur at the ends of the strip.

Some example arrangements are described.

Also described are elongate base strips that include a female member adjacent to, and spaced from, the male member: such base strips being usable in a double seal or double zipper application. Also described are zipper closure arrangements in which a male member as described above, is positioned in engagement with a female member of a second base strip. Double closure arrangements in which one side uses such features as described are also characterized.

Further, pouch arrangements including zipper closure arrangements as characterized above are described. Also, methods of assembly are also described. Methods of modifying a male member to generate a clicking sensory male member are discussed.

There is no specific requirement that a reclosable zipper closure arrangement member, feature or assembly, include all of the specific features characterized herein, in order to obtain some benefit. Further, there is no specific requirement that a reclosable pouch or bag and/or techniques applied to generate closure members and/or pouches involve all of the specific features characterized herein, in order to obtain some benefit according to the present disclosure.

DETAILED DESCRIPTION

Figure 1:
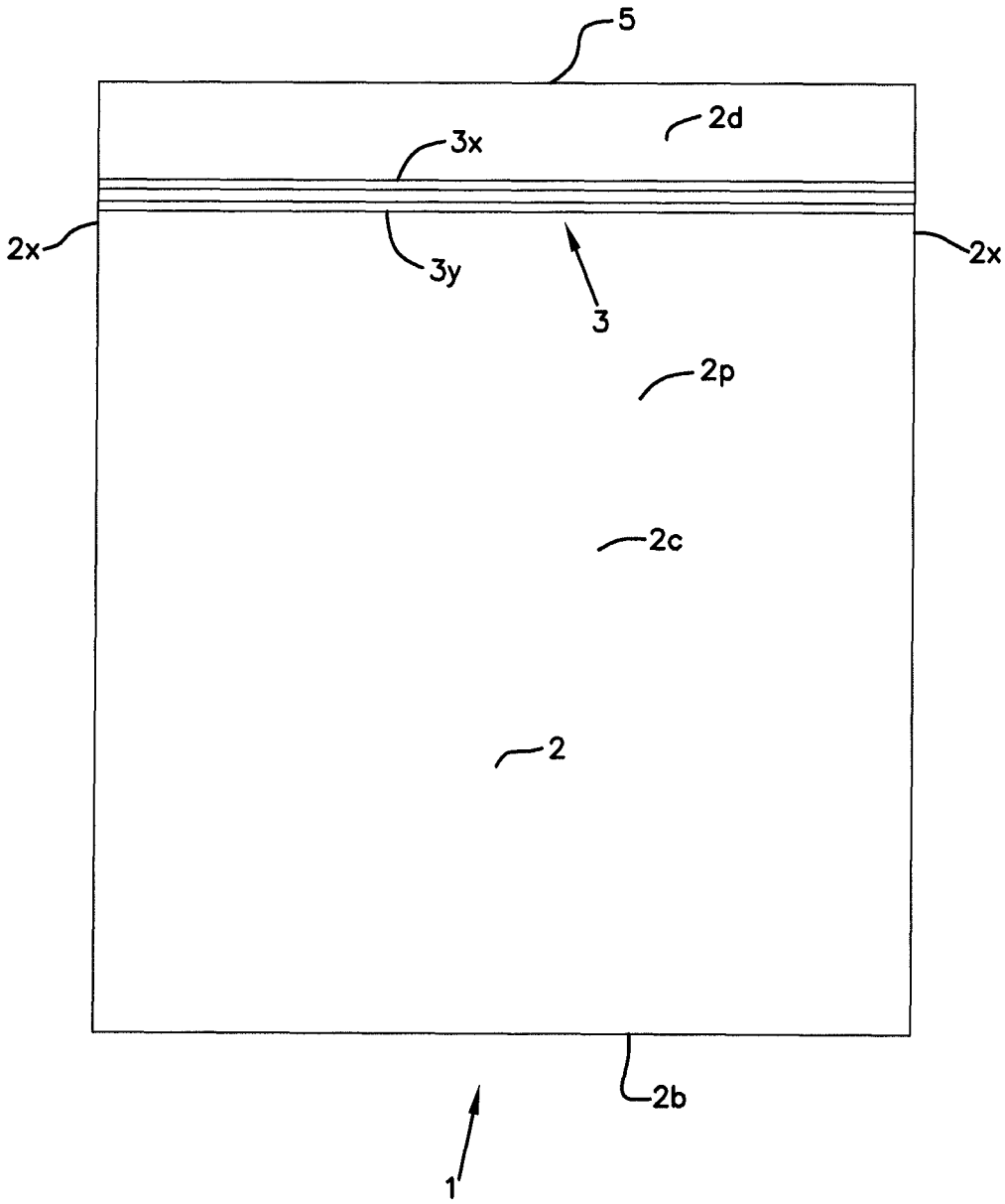
FIG. 1 is a schematic plan view of a reclosable bag or pouch arrangement including a pressure actuated zipper closure arrangement constructed in accord with the present disclosure.

I. Reclosable Pouch or Bag (Package) Arrangements with Clicking Sensory (Audible and/or Touch Sensitive) Closure Indicators, Generally A. Bag or Pouch Features, Generally The reference numeral 1, FIG. 1, generally indicates a package arrangement (reclosable bag or pouch arrangement) in accord with the present disclosure. The package arrangement 1 generally comprises a thermoplastic bag 2, provided with a reclosable (zipper) closure arrangement 3 thereon. The reclosable closure arrangement 3, is sometimes referenced as a zipper arrangement or zipper closure. It generally extends with closing capability across the pouch or bag 2 adjacent to, and spaced from, an open end 5 thereof.

Reclosable closure arrangement 3 is generally positioned interiorly of the pouch 2, between opposite side panels 2*p* thereof. Finger (for example thumb) pressure applied to the outside of the bag 2, opposite the closure arrangement 3, along a path of longitudinal progression between opposite pouch sides 2*x*, generally closes the arrangement 3 in a zipper lock or pressure lock fashion.

In general terms, the package 1 includes a pouch 2 and closure arrangement 3 configured from thermoplastic materials. Often the construction is with heat seals or seams provided along the sides 2*x*. Typically a bag bottom end or edge 2*b*, is either heat sealed closed or comprises a continuous fold in the material of the pouch 2. The pouch 2, as a result, generally comprises opposite side panels 2*p* of material, of which one side 2*p* is viewable in FIG. 1, the second forming an opposite panel or face.

The closure arrangement 3 is generally positioned with zipper closure features or tracks thereof adjacent, but spaced from, an open end 5 of the bag 1 and is used to seal the bag 2 closed, as desired. Typically, the closure arrangement 3 is not positioned with the closure track features immediately adjacent the open end 5.

In general, the closure arrangement 3 is sometimes referenced as dividing the pouch 2, i.e. panels 2*p*, into a package side 2*c* and an opening or consumer side 2*d*. The package side 2*c* is an interior portion of the pouch 2 that is sealed closed by the reclosable arrangement 3. The opening or consumer side 2*d* is the side of the pouch 2 between the zipper, closure, portion of arrangement 3 and the open edge 5.

Again, the closure arrangement 3 generally comprises interlocking (or interlockable) strips of closure material positioned on each of the two panels 2*p*, and oriented aligned with one another: so that pressure in a direction between the two panels 2*p* and moved along the direction between the edges 2*x* will (when the strips of closure material are properly aligned) cause engagement and closure (sealing); and, is such that pulling the two panels 2*p* apart adjacent the closure arrangement results in unlocking or opening (unsealing) of the bag or pouch 2.

In many instances, the closure arrangement 3 is provided with first and second closure tracks or zipper tracks, positioned adjacent to, and spaced from, one another. Such a closure arrangement is sometimes referenced herein as a double closure arrangement.

In FIG. 1, an example of such an arrangement is shown by closure arrangement 3 having closure tracks 3*x*, 3*y*. In the example, the closure tracks 3*x*, 3*y*, extend generally parallel to one another, and are spaced from one another but are sufficiently close so that both can be operated simultaneously for closing, upon sliding motion of a person's finger or thumb. Also, preferably the tracks 3*x*, 3*y* are sufficiently far apart to create a feel to the operator that there are two extensions 3*x*, 3*y*, that are closing. A typical, on center, spacing of tracks 3*x*, 3*y* will often be within the range of 2-8 cm, inclusive, typically within the range of 3-7 cm, although alternatives are possible.

There is no specific requirement that the two arrangements 3*x*, 3*y* be identical to one another. Indeed, in many instances, there are varied from one another. For example, one may be inverted relative to the other, with respect to direction of male and female member projections. Also, one may be configured to provide a clicking sensor indicator (tactile sense and/or audible sense) of locking, whereas the other one may be configured for a more secure section interlock or seal. This latter is a typical pattern, and when it is used, often the closure 3*y* on the package side 2*c*, i.e. closer to the contents in the bag 2, is provided with a stronger lock or seal; and, the closure 3*x* closest to the opening end 5 (consumer side 2*d*) of the bag 2 is provided with a clicking sensory indicator arrangement or mechanism that provides audible and/or touch indication of closure.

Again, herein, the term "clicking sensory" when used in connection with defining a zipper closure arrangement, is meant to refer to a closure arrangement that is configured to provide an indication of a proper engagement or sealing by a repeated clicking sensation achieved as the closure occurs. The clicking sensation or indication can be provided audibly (by sound) or by touch (tactile) sense or both. The term "clicking sensory" in and of itself is not meant to include within its scope, arrangements that only (or merely) indicate of sealing by color change. Rather, the term "clicking" is meant to specifically reference an arrangement configured to repeatedly click (detected by touch and/or feel) as the closure or sealing occurs.

Herein, when it is said that the continued elongate first male member comprises a clicking sensory indicator male strip, it is meant to indicate that the male strip is configured in a manner that will provide the repeated clicking action, when it is used in association with an appropriate female member, during closure of the zipper arrangement. An example modification is described, in which the male strip comprises alternating first and second sections which will engage the female member differently to cause the clicking.

In many instances, the closure arrangement 3 comprises an extruded thermoplastic construction (for example from linear low density polyethylene (or LLDPE) that is premade and then secured to thermoplastic material from which the pouch panels 2*p* are formed. Often when the closure arrangement 3 comprises first and second tracks 3*x*, 3*y*, the two partial tracks 3*x*, 3*y* of each one of the two strips (one mounted on each pouch) are extruded together during assembly. That is, typically arrangement 3 comprises a first strip on one pouch and a second strip on a second pouch. The first strip would be extruded with two tracks corresponding to half (or one side) portions of tracks 3*x*, 3*y* thereon; and, the second strip would be extruded with two tracks corresponding to half (or one side) portions of tracks 3*x*, 3*y* thereon; and, and then, the two strips would be positioned in the pouch 2 opposite one another in a manner than can be selectively and repeated by closed and sealed.

B. Clicking Sensory (Audible and/or Tactile) Closure Indicators, Generally

Clicking sensory (i.e. audible and/or tactile) indication of closure is generally provided by creating longitudinal variation in at least one of the closures 3*x*, 3*y* such that as the finger is moved along the longitudinal extension, of the closure arrangement 3, a regular clicking sound and/or clicking or bumpy feel is caused as locking (sealing) engagement occurs.

Generally, each of the closures 3*x*, 3*y* comprises a female member and a male member. The clicking sensory indicator is provided, typically, by configuring a male member as a "clicking sensory indicator male strip." By this, again, it is meant that the male member is configured so that as it is press fit with a female member, the clicking occurs as closure takes place.

It is desirable that the lock or closure indication function (clicking sensory indicator) be provided by structural features that: are convenient to provide; and, that do not create a false indication of closure. For example, if a portion of the closure arrangement 3 (underneath structure contacted by the users' fingers as closure occurs) is sufficiently bumpy whether closed or not, a bumpy or clicking feel to the user, as the finger is slid along the pouch 2, over closure arrangement 3, may cause an impression of zipper closure (sealing) has occurred when it is not. The techniques described herein, are, in part, provided to inhibit problems from this issue.

It is also desirable to provide a closure arrangement that can be assembled and used in an inexpensive and convenient manner. This can be accomplished with the techniques described.

II. Improved Closure Arrangements; Resulting Packages; and, Methods of Assembly and Use A. General In general terms, a zipper closure arrangement as characterized herein is an arrangement which includes a first (elongate) base strip positioned (or positionable) on one pouch panel or side; and, a second (elongate) base strip that is positionable (or positioned) on a second pouch side opposite the first side. The two base strips are generally positioned in an interior of the thermoplastic pouch. One base strip, for example a first base strip, will generally include a first male member of a closure arrangement and a second base strip will include, in engagement (or engageable) alignment with the first male member on the first base strip, a female member of a closure arrangement. Generally, the first male member and corresponding female member are configured so that sealing occurs as the male member is press-fit into the female member (or the female member is press-fit over the male member).

In a typical double closure arrangement, the first base strip includes the first male member and a second closure member, typically a female member; and, the second base strip includes the first female member and a second closure member, typically a second male member. With such a double arrangement, two sealing arrangements are provided inverted with respect to one another in terms of male/female member orientation and direction of extension.

In the next portions of the section, specific examples are provided.

B. A Strip of Undistorted Zipper Material

The techniques described herein can, in some instances, be applied such that both halves of the closure arrangement, i.e. a half mounted on each panel, can be formed by using as a starting material a single extruded zipper member, which is then used to create two strips: a first which comprises an undeformed, unmodified or undistorted portion of the initial closure strip; and, a second which comprises a deformed, modified or distorted, portion of the initial closure strip. However, this would not be a typical preferred application. A reason for this is that it is also typically preferable that female and male members of the zipper tracks 3*x*, 3*y* be asymmetric and oriented in a preferred manner. Thus, typically and as indicated in the drawings, the closure strip mounted on a first one of the two panels 2*p* is varied from the strip mounted on a second one of the two panels 2*p* in a manner that is generated by separate extrusions of the two through different die configurations. This will be understood from discussion below.

Herein, the term "undistorted" or "unmodified" in connection with the zipper half or closure half is meant to refer to a closure half that has not been modified substantially from the configuration it possessed when initially extruded and cooled. The term "modified" or "distorted" is meant to refer to a zipper half that has been substantially modified in configuration after initial extrusion. The modification is typically what generates a functional portion of a clicking sensory indicator arrangement, as will be apparent from the following discussions.

Figure 2:
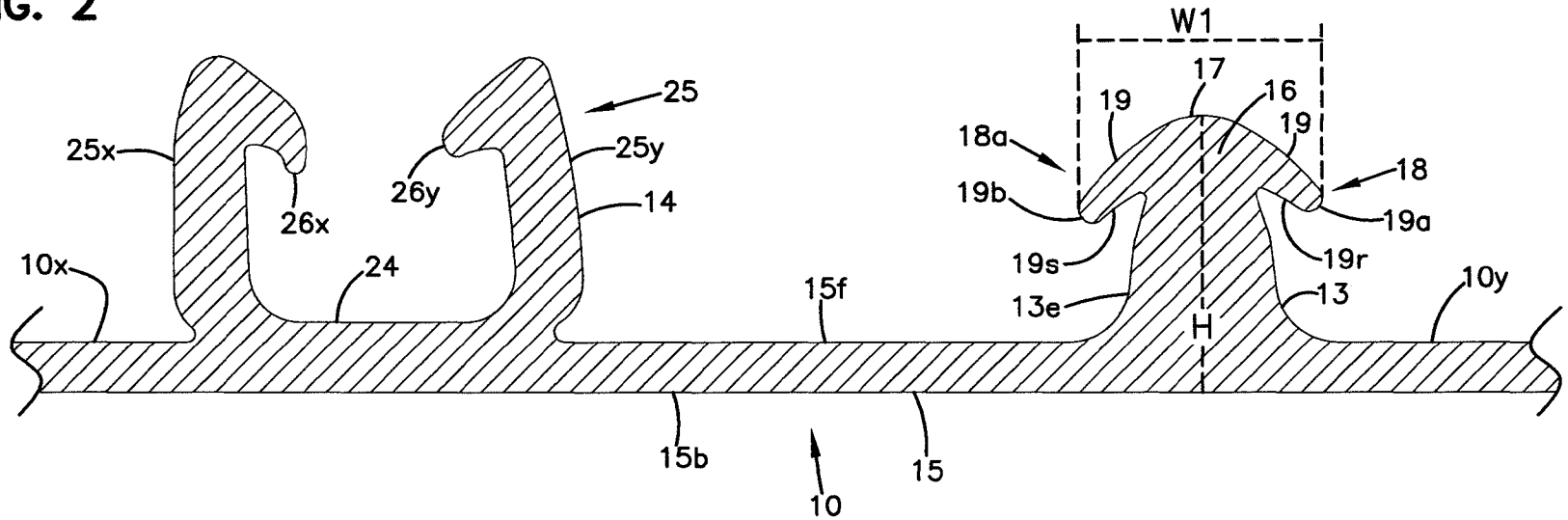
FIG. 2 is a schematic fragmentary cross-sectional view of a portion of an undistorted zipper closure half usable in the construction of arrangement of FIG. 1.

Attention is now directed to FIG. 2, in which a portion of an example unmodified or undistorted zipper half or closure half useable in applications according to the present disclosures is depicted at 10, in fragmentary cross-sectional view. The zipper half 10 is useable to construct half of a double line (3*x*, 3*y*) closure arrangement such as closure arrangement 3, FIG. 1. By the term "half of a double line" in this context, reference is meant to an extrusion that would be mounted on one of the two panels 2*p*. That is, the zipper half 10 depicted in FIG. 2, can be used to form a half of each of the strips 3*x*, 3*y*, mounted on one of the panels 2*p*.

The zipper half 10 would generally be extruded in a continuous line, with a cross-section of male and female members thereon, in various locations thereof, being generally as shown schematically in FIG. 2. Thus, the closure arrangement of zipper half 10 includes a continuous first male member 13 and a continuous first female member 14, each with a continuous longitudinal extension of relatively constant cross-section as shown.

Because the strip 10 has a male member 13 and a female member 14, it could be used in a pouch arrangement with two sections of strip 10 oriented and inverted relative to the other, to form both sides of a zipper 3. However, as indicated above, this would typically not be preferred. By "inverted" in this context and similar ones herein, it is meant that a section of strip 10 could be engaged with a strip identical to itself, with a male member of each strip engaging a female member of the other strip. Thus, the two adjacent tracks (corresponding to tracks 3*x*, 3*y*) would be inverted when used in a pouch such as pouch 1. Alternately stated, a section of strip 10 on panel 2*p*, would engage a section of strip 10 on an opposite panel 2*p*, with the two tracks 3*x*, 3*y* being the same, but inverted relative to one another (with respect to direction of male projection and female projection).

As indicated, it is generally not preferred that the same strip of configuration 10 be used to provide each of the halves (one on each pouch face 2*p*) of the closure arrangement 3. A reason for this is that the male member 13 and female member 14 are preferably each asymmetrical around a central plane therethrough, to provide advantages as discussed below.

In general terms, the strip 10 includes a base 15, with the male section, member or side 13 and the female section, side or member 14 positioned thereon. The base 15 can be characterized as having a back side 15*b* and a front side 15*f*. Typically, the back side 15*b* is featureless and it is the front side 15*f* that has the male member 13 and female member 14 thereon. Typically, when mounted in a pouch, the back side 15*b* is heat mounted on one of the panels 2*p*, along an inside surface thereof.

Referring to FIG. 2, the male member 13 generally comprises an elongate, continuous, member 13*e* positioned on front side 15*f* and comprising: a central, continuous, male rib projection 16, with a head or peak 17 remote from base 16; and, a closure lock arrangement 18, in the example comprising arm arrangement 18*a*. In the example the arm arrangement 18*a* comprises at least one, and in the example first and second, opposite, continuous side arms 19 (19*a*, 19*b*) on opposite sides of the rib projection 16 and peak 17. Often, the side arm(s) 19 (19*a*, 19*b*) are configured, as depicted, positioned angled toward the base 15 from peak 17. The side arm(s) 19 (19*a*, 19*b*) provide for engagement recess(es) 19*r* thereunder, on opposite sides of the arm(s) 19 from the peak 17; and, between the arm(s) 19*a*, 19*b* and the base 15. The engagement recess(es) 19*r* are locking receiver(s) or region (s) for locking engagement with portion(s) of another female member, as discussed below.

A height dimension H of the male member 13 is indicated in FIG. 2. The dimension H is meant to reference a height of rib projection 16 from backside 15*b* to peak 17. Typically and preferably when the extrusion of zipper half 10 occurs, the male member 13 is configured continuously with a constant or relatively constant cross-section, i.e. so that is does not vary substantially along its length. That is, typically the peak 17 is continuous and uninterrupted.

Although alternatives are possible, for typical arrangements height H and strip 10 will be within the range of 0.95-1.5 mm, usually 1.0-1.5 mm.

It is noted that for the particular male member 13 depicted, the arm arrangement 18*a* is asymmetric (not symmetric) around peak 17. While this can be the case and is advantageous, it is not required in all applications of the present techniques.

More specifically, for the strip 10, region 10*x* will generally represent the package side when the strip 10 is mounted in a pouch 1; and, region 10*y* will represent (be positioned toward) the consumer side 2*d*. Thus, for pouch 1, FIG. 1, the particular strip 10, if used, would be on a lower one of the panels 2*p*. The referenced asymmetry in the male member 13, and particularly in the arm arrangement 19, is that arm 19*b*, which is the package side arm, is a little longer and extends a little more sharply downward toward base 15, than does the consumer side arm 19*a*. Features resulting from this are discussed further below.

Typically height H does not vary along a longitudinal extension of the male side 13 by more than 0.22 mm, often not more than 0.2 mm (and typically not by any more than 0.15 mm, usually not more than 1.0 mm) over any section of longitudinal extension of 4 cm (and often does not have more than such a variation over any section of extension of 6 cm) except as it may be modified at opposite ends of strip 10 adjacent sides 2*x* of a pouch 1 in use. If there is any variation in the height H along a continuous extension of rib 16, except at ends, it is typically minimal, preferably is not regular, and most preferably does not result in any sharp or abrupt changes in height. Indeed, in a typical extrusion operation, height variation if any (in dimension H) will be minimal and be no more than 0.08 mm.

Advantages from a relatively constant height H and lack of regular abrupt changes in H along the length of peak 17, concern ensuring that the feel of peak 17, to the person closing the bag, will not generate a regular bumpy or clicking feel that could be improperly interpreted as a sealing or locking of the zipper closed.

Although alternatives are possible, typically dimension W1, FIG. 2, which corresponds to a maximum width of the male member 13, in particular the lock arrangement 18 (i.e. arm arrangement 18) is at least 0.8 mm, and usually within the range of 0.85-1.1 mm. Typically, the maximum width W1 of the arm arrangement 18 occurs at a location that is spaced form the peak 17 typically no more than 50%, often no more than 45% and preferably no more than 40% of a distance H from the peak 17 toward the back side 15*b*. Most typically, the greatest dimension of width W1 is located within a distance of 0.5 mm from the peak 17, usually within 0.45 mm of the peak 17, in an undistorted strip 10.

In the example strip 10 depicted, a female member 14 is also positioned on the front side 15*f* of base 15 and is configured to define a central, continuous, elongate receiver recess 24 positioned within a side lock member arrangement 25, in the example depicted comprising opposite hook sides 25*x*, 25*y*, each configured with projection or hook member 26*x*, 26*y*. The female member engages (or is engaged by) a male member analogous to male member 13 but mounted on a different base, by having the male member received in recess 24 with the sides 25*x*, 25*y* press fit over a peak 17 and lock arrangement 18. That is, during closure, sealing or zipper locking, a female member analogous to female member 14 is press fit over a male member analogous to male member 13, until snap-fit occurs in the example with the hook members 26*x*, 26*y* being received in respective ones of the recesses 19*r*.

It should be understood that in a given strip 10, the female member 14 on the base strip does not engage a male member 13 on that same base strip during closure. Rather, a second strip of closure material would be configured so that an analogous female member to member 14 could engage a corresponding male member analogous to male member 13 on the first strip. In a double enclosure which uses inverted strips, a female member on the first strip would be engaged by a male member on the second strip.

Referring to FIG. 2 and female member 14, it is noted that hook member 26*x* is longer in extension, and includes a tip that extends somewhat more sharply toward base 15, than does hook member 26*y*. The longer member 26*x* is generally the one positioned toward the package side 10*x*. It is preferably configured to engaged with a longer deeper arm of a male member, analogous to arm 19*b*, when it is sealed. This would help ensure a more secure sealing directed toward the package side.

From the above discussion of asymmetry in female member 14 and male member 13, it can be understood that, for the example depicted, generally the female member 14 shown is not specifically configured for engagement with the particular male member 13 depicted, but rather with a male member that would be a mirror image of male member 13, with respect to cross-section. This will be typical, as, again, it helps ensure the seals formed along the package side of the resulting closure(s) are a little stronger. However, the techniques described herein can be applied in arrangements in which the male member 13 and female member 14 are each symmetrical around a central plane, in cross-section.

B. Variation to Strip 10 to Provide Clicking Sensory (Audible/Tactile) Indication of Closure In a section of a reclosable closure arrangement 3, FIG. 1, in which a clicking sensory (tactile or audible) indicator is desired for an indication to the user of lock or seal closure, it is desirable to provide a variation in the feel/sound of the closing, as the users' finger(s) run across the zipper 3. This can be provided, by causing intermittent (alternating) variation along a longitudinal extension of strip 10, typically in the male member 13.

Herein, a male member which has been configured (or modified) to provide for clicking sensory indication, when used with a female member, will sometimes be referred to as a "male member comprising a clicking sensory indicator male member" or by similar terms. By this it is meant that the male member is configured so that when used with a female member of the type characterized herein, the clicking sensory indication will occur. As suggested above, this is generally done by providing the clicking sensory indicated male strip or member with alternating (or intermittent) variations along its length such that, as press-fit with a female member occurs, causes the repeated bumpy feel and/or clicking sound is caused.

It is desired that this intermittent variation is preferably provided in a manner that does not affect substantially the constancy of height H of the male side 13 along its length. A reason for this, again, is that if the user feels a relatively regular, alternating, variation in that height H, as the finger moves along the zipper, the user may interpret that variation in feel as a clicking sensory indication (tactile sense) of closure or sealing, when a sealing closure is not necessarily occurring. Thus, in general, it is desired that the closure arrangement involve providing modification to the male section 13 along its longitudinal length in a manner that does not substantially affect the height H along that same longitudinal length.

Preferably the height H (or peak 17 configuration) is maintained constant, but in general, what is preferred and desired is: any variation in height provided along a length of the male section 13 (except at ends in a pouch 2) be relatively smooth and not jointed or stepped; and, not be a regular variation that could lead to an inappropriate tactile signal (clicking sensory indicator) of closure. Preferably, in the clicking sensory indicator male member, the height H does not vary any more than 0.22 mm, usually no more than 0.2 mm, more preferably no more than 0.15 mm, typically no more than 0.1 mm and in some instances no more than 0.08 mm, over a length of extension of at least 4 cm, often over a length of extension of at least 6 cm. This is, generally, a maximum preferential, variation in a member with a continuous peak.

To create the clicking sound and/or tactile feel of closure when it does properly occur, it is desired to provide the male section 13 with alternating variations in locking engagement with a female side, along its longitudinal extension. It is preferable that the variations be regular, i.e. comprise a plurality of different sections that alternate with one another, along a longitudinal extension of the male side 13.

In a typical application of the techniques described herein, this variation is provided by having one of the sides 3*x*, 3*y* be configured so that: (a) in first sections, the male member 13 can be engaged by an appropriate female member (analogous to member 14) being pushed over the locking arrangement 18 into locking engagement by projecting into at least one (and if two are present, both) of the regions 19*r*; and (b) in second sections, the lock arrangement 18 is modified so that the female member (analogous to member 14) cannot be pushed over the arm arrangement 18*a* with projection of either of the hook(s) 26*x*, 26*y* into receiver regions underneath arms (19*a*, 19*b*).

Although alternatives are possible, the unmodified sections, or first sections, typically each are configured to extended over a distance of at least about 2.5 mm typically not more than 7 mm and usually within the range of 3-6 mm, inclusive; and, the modified regions or (second) sections are typically configured to extend over a distance of at least 2.5 mm, not more than 7 mm and usually an amount within the range of 3-6 mm, inclusive. Typically, a length ratio of the unmodified sections to modified sections, within a given elongate male member is within the range of 0.75:1 to 1.5:1, inclusive, and is usually within the range of 0.9:1 to 1.3:1, although alternatives are possible.

The first (unmodified) sections and the second (modified) sections typically alternate with one another along the length of extension. Thus, during closure, the user would typically both feel and hear snap (clicking) closure of the female member over the male member in the first (unmodified) sections; and will not feel and/or hear as strong of a snap-fit sealing engagement in the regions of the second (modified) sections. This creates the regular clicking seal and/or bumpy (clicking) feel of an indication of closure in one of the strips 3*x*, 3*y*.

Typically, when a double closure is included, the strip chosen for this clicking sensory indicator is the one adjacent the consumer side 2*d* or open end 5 of the pouch 2.

It is preferable that the modifications to the male member 13 be ones that can be made to a previously undistorted male side 13, after initial extrusion of the zipper half 10. A reason for this is that it is preferred that the initial extrusion be a constant one to generate a consistent strip which is then modified for use as a zipper half in a system in which an audible and/or tactile indication of closure is to be provided.

Figure 3:
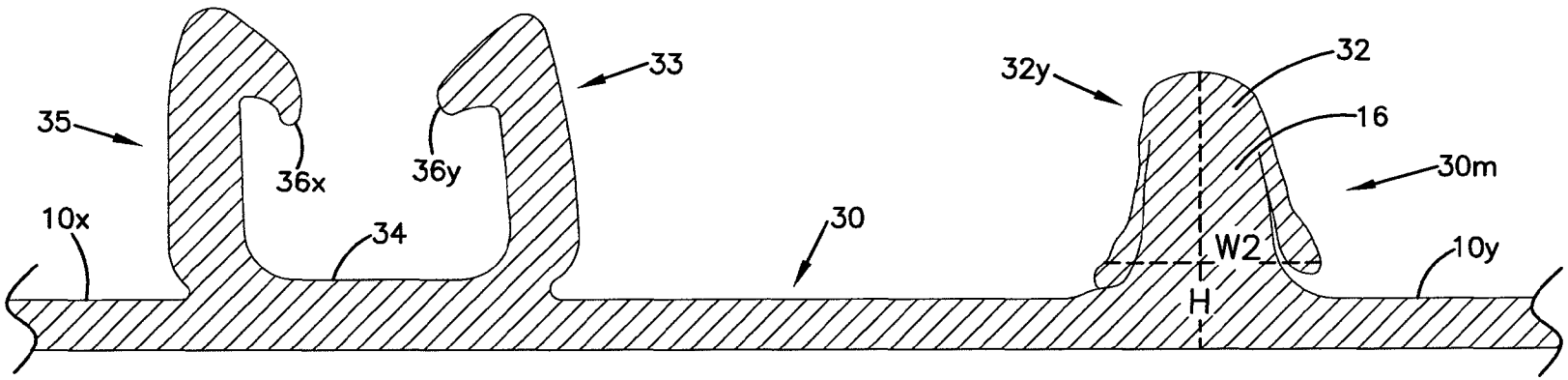
FIG. 3 is a schematic fragmentary cross-sectional view of a portion of a modified or distorted zipper closure half usable in the arrangement of FIG. 1 and made using the zipper closure half of FIG. 2.

Such a modified zipper half is indicated in cross-section, in FIG. 3. Referring to FIG. 3, at 30, a zipper half is depicted, generally in accord with zipper half 10 but indicating a cross-sectional view through a modified portion 30*m* of a corresponding male member.

It should be understood that, along its longitudinal extension, the zipper half 30 would have alternating first sections of cross-section similar to FIG. 2, and second sections of cross-section similar to FIG. 3. As will be understood from further discussion below, there will also typically be short transition regions between the first and second sections.

Referring to FIG. 3 the zipper half 30 depicted comprises a male member 32 and a female member 33. The female member 33 is generally analogous to female member 14, comprising recess 34 and side lock member arrangement 35, comprising sides 35*x*, 35*y* and lock projections 36*x*, 36*y*. Indeed, it is anticipated that in a typical application, as suggested above, zipper half 30 will have been formed from the zipper half 10; and, preferably, female member 33 will be unmodified, i.e. will be identical to the female member 14 of the unmodified strip 10.

Figure 6:
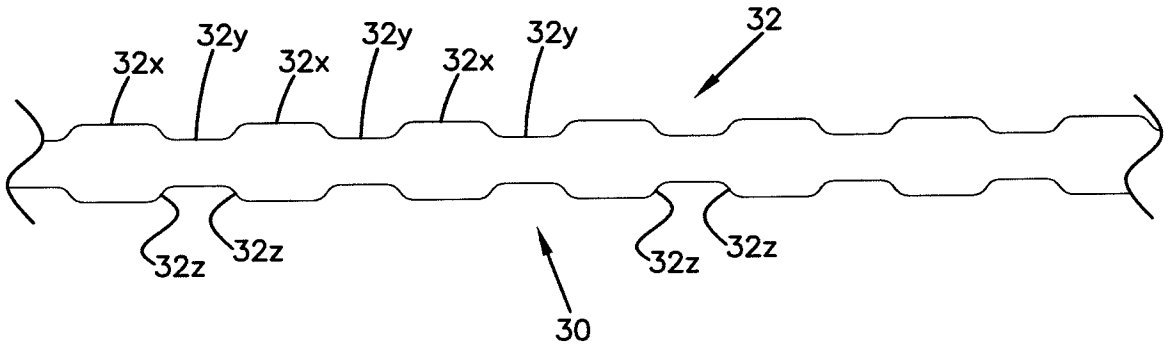
FIG. 6 is a schematic, fragmentary, top plan view of the portion of a distorted zipper half constructed using the techniques of FIG. 5.

The male member 32, however, is modified from male member 13, in selected intermittent (second) sections 30*m* along its longitudinal length. That is, again, there would typically be cross-sections of zipper half 30 that are identical to zipper half 10, but the cross-section of FIG. 3, is taken to indicate wherein an example of deformation, distortion or modification to male member 13 has occurred, to provide male member 32. This can be understood, for example, by reference to FIG. 6, in which the male member 32 of zipper half 30 is shown in schematic top plan view, and one can see alternating first (undistorted) sections 32*x* and second (distorted or modified) sections 32*y*, with short transition regions 32*z* therebetweeen.

Referring back to FIG. 3, in which the cross-sectional view 30*m* is taken through one of the deformed, distorted or modified sections 32*y*; the basic deformation approach used is to deform the locking arrangement 18, in the example by modifying the side arm arrangement 18*a* toward rib 16 by collapse in a direction toward base 15 in a manner that distorts the arm arrangement 18*a* such that corresponding lock projections (analogous to projections 36$x$, 36$y$) on a female member (analogous to member 33) cannot snap-fit by projection into a region between the arm arrangement 18$a$ and the base (corresponding to recesses 18$r$, FIG. 2) as it would in an undistorted region 30$x$. It is noted that the approach to deformation preferably is one that does not substantially modify the continuous nature of the peak 17 and the relative constancy of its height (H) along its length.

Figure 4:
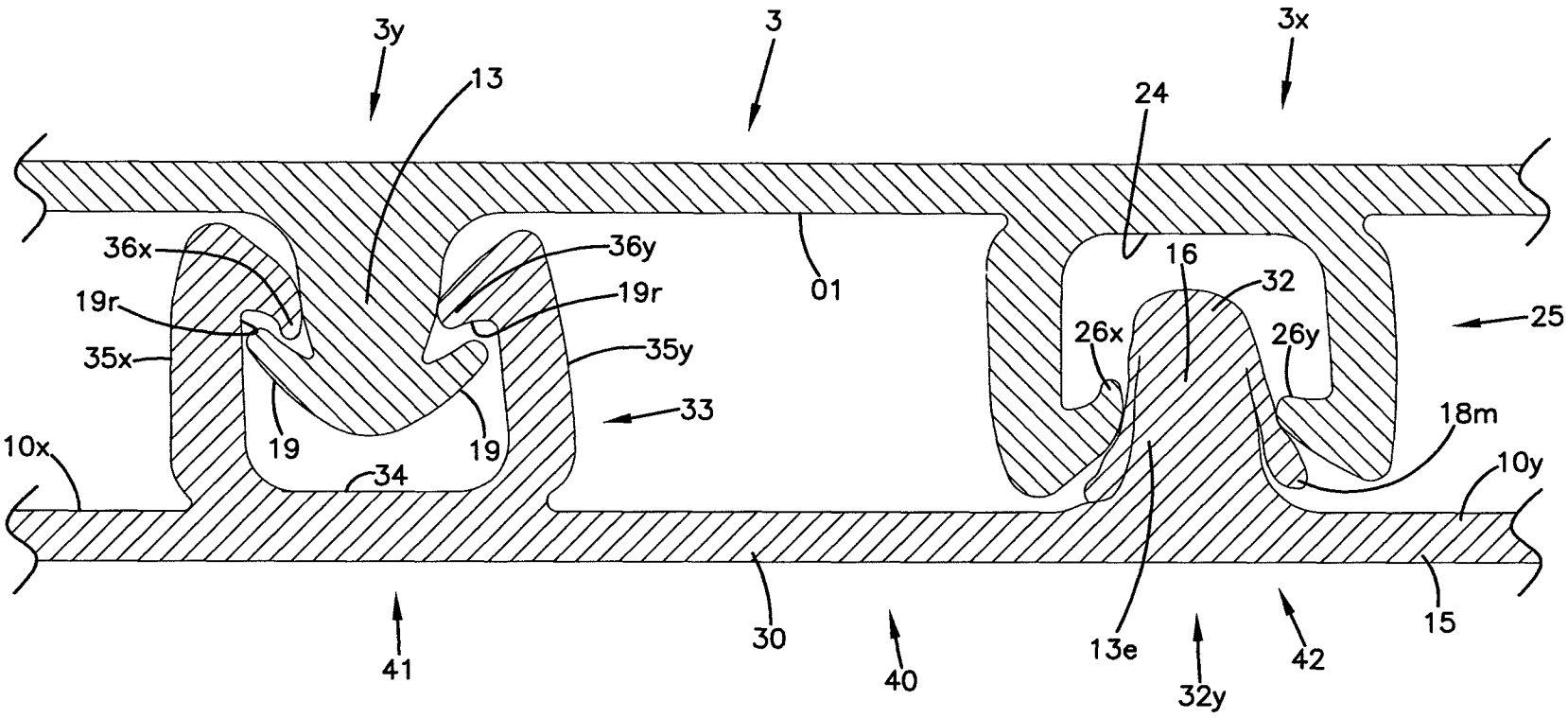
FIG. 4 is a schematic fragmentary cross-sectional view of the portion of a zipper half of FIG. 4 engaged by a portion of a second zipper half in a manner useable in the arrangement of FIG. 1.

In FIG. 4, a schematic cross-sectional view is taken through a closure arrangement 3, and depicts two tracks 3$x$, 3$y$ adjacent one another (but not mounted on a pouch). The closure arrangement 3 depicted in FIG. 4 depicts a modified zipper half 30 in engagement with a non-modified zipper half 01, (half 01 of FIG. 4 being a mirror image of half 10, FIG. 2) and with the cross-sectional view taken through a region 32$y$ of the zipper half 30 where modification has occurred. (If the cross-section were taken through a section 32$x$ of zipper half 30 where modification has not occurred, then the depicted section of strip 30 would appear like strip 10, FIG. 2).

Referring to FIG. 4, the package side is indicated at 10$x$ and the consumer side at 10$y$. It can be seen that strip 01 is a mirror image of strip 10 of FIG. 2, but otherwise possesses the same features, and like numerals are used to indicate them. This helps ensure that most secure locking occurs along the package side 10$x$ of each of the zipper locks 3$x$, 3$y$.

Referring to FIG. 4, the zipper section 40 depicted, then, comprises a first, closed, zipper extension 41 and a second, closed, zipper extension 42.

The first, closed, zipper extension 41 is intended to be indicative of a zipper extension that comprises a closure that does not involve the clicking sensory (tactile and/or audible) indicator according to the present disclosure. Thus, male member 13, of strip 01 is shown engaging a female member 33 of strip 30, with the member 13 being received within recess 34 and with the side lock arrangements 35$x$, 35$y$ press-fit over arms 19, to engage in a hooking or locking manner, by projections 36$x$, 36$y$, extending into regions or receivers 19$r$. Again, typically the zipper extension 41 will be positioned on the package side; i.e. toward the closed end of the bag 1 and away from the open end 5 of the bag 3, FIG. 1.

Still referring to zipper extension 41, it can be understood that more robust sealing occurs where arm 36$x$, the longer arm with a projecting tip, engages the recess formed in the arm arrangement 18$a$ by arm 19$b$.

Attention is now directed to zipper extension 42. Again, zipper extension 42 is a cross-section through one of the regions 32$y$. If the cross-section were taken through one of the regions 32$x$, instead, where modification to the male side 13 and zipper half 10 has not occurred, the cross-section would appear similar to the cross-section through zipper extension 41 (but inverted and mirror image). However, since the cross-section of zipper extension 42 is taken through a modified section 32$y$ of the male member 32, it can be seen that the corresponding male member 32 is received within a recess 24 of female member 25; and, because the modified arm arrangement 18$m$ has been generated by distorting arms 13 toward the stem 13$e$ and base 15, there is modification in the engagement with female member 25. In general, that engagement is such that while the female member 25 fits over the modified arm arrangement 78$m$, it cannot extend past the modified arm arrangement 18$m$ in a snap-fit manner with projections 26$x$, 26$y$ snap-fit toward rib 16 (into receivers analogous to receivers 19$r$) and underneath arms on the male member 32 to a location however any arm and the base 15.

It can be understood that while the zipper extension 42 is locked along its length, for example by moving a finger over the longitudinal extension while applying pressure, and simultaneously closing extension 41, variations in closure would be sensed (felt and/or heard) along the longitudinal extension, as regular clicks or bumps, as the finger passes longitudinally along alternating sections 32$x$ and 32$y$. This is because resistance to the hooking of the female member 25 over the male member 32 as the pressing of the recess occurs, will vary between sections 32$x$ and 32$y$.

It is also noted, however, that there would not be a tactile sensation contribution provided by variations in the height H since the distortion to the male member described does not generate a substantial variation in peak 17 and variation in its relative constancy of height H along the extension of modified strip 30. Rather, height H will generally be constant, or with, at most, only minor and gradual variations in H along the extension (except at very ends). Thus, the configuration of the top or peak region 17 of strip 30 will not be as likely to send a false signal of locking or sealing to the user.

II. Method of Assembly of the Modified Strip 30

The modified strip 30 can be constructed in a variety of manners. Typically, it would be constructed from an unmodified zipper half 10, which is put through a process of intermittent modification; i.e. modification of selected, spaced, segments of the male member or strip 16 along its length, so that there are alternate unmodified (first) and modified (second) sections. Typically, transition regions 32$z$, FIG. 6, between the sections are formed not sharp 90° angle sections, but rather are more gradual, in transition, as shown schematically.

Again, typically, a widest dimension W1 of the arm arrangement, FIG. 2, is located within 50% of H of the peak 17. Typically, after distortion, the locking arrangement 18 (in the example arm arrangement 18$a$) has been distorted toward the center rib 16 and base 15, FIG. 3, so that a widest portion of the arm arrangement 18$a$ (indicated at W2) is spaced from peak 17 further than 50% (usually at least 55%, often 60% or more) of height H of the peak 17 toward base 15.

Figure 5:
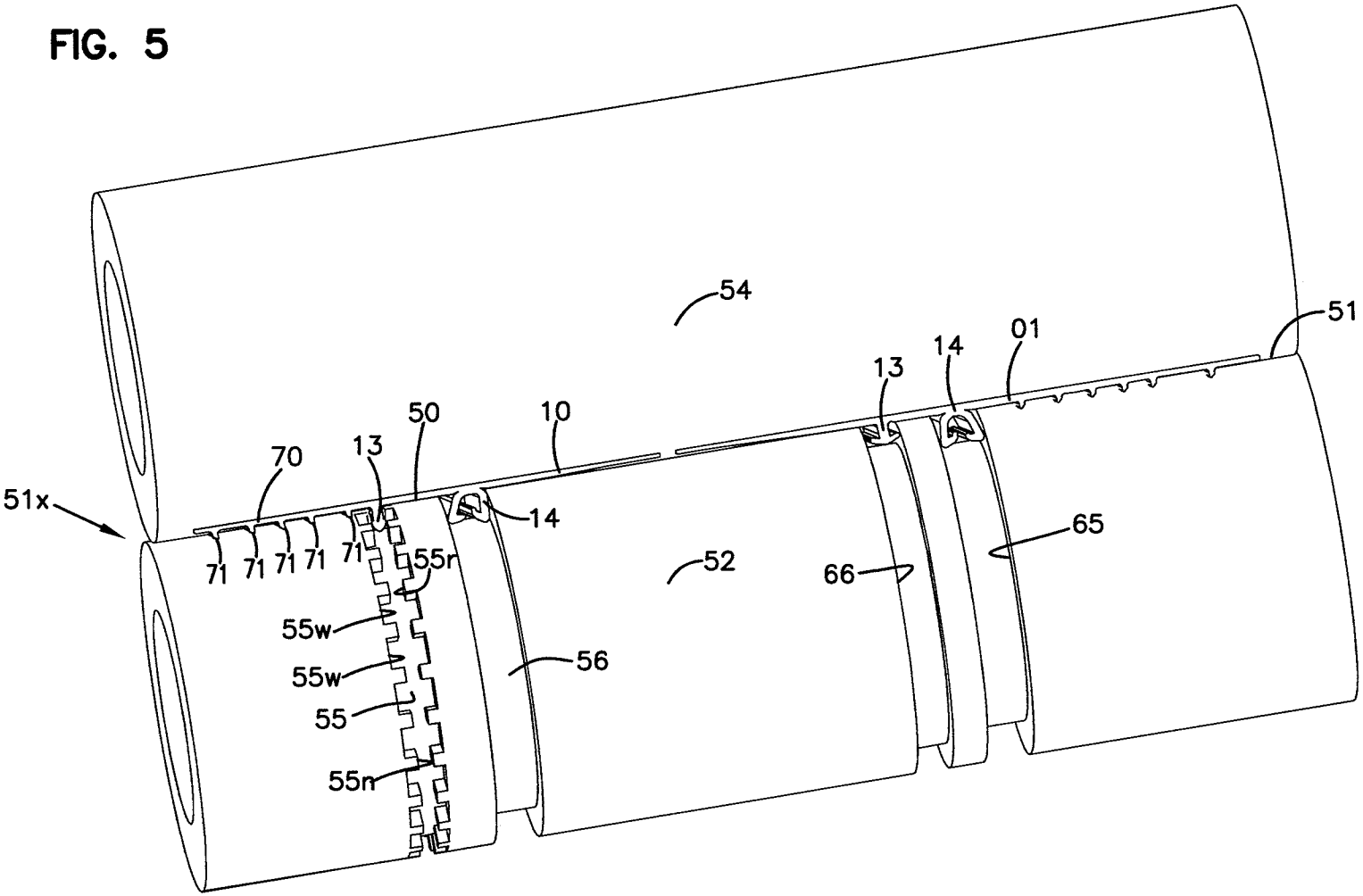
FIG. 5 is a schematic view of a process useable to form the portion of a distorted or modified zipper half.

An approach to generating such a modified strip 30 can be understood by reference to FIG. 5, a schematic depiction of an assembly usable to generate the modified strip 30 from an unmodified zipper half 10.

Referring to FIG. 5, an extruded section 50 of zipper half 10 (actually a mirror image of strip 10, FIG. 2) is shown, being pushed through a bite 51 in a roller arrangement 51$x$ between a pair of rollers 52, 54. Roller 52 includes first and second grooves 55, 56, therein. Groove 56 is a receiving groove for a female member 14 of the strip 50 and is configured not to modify the female member 14. Groove 55 on the other hand is a modifying groove, which receives the male side or member 13 therein, during operation, and modifies the male member into alternating first (unmodified) sections 32$x$ and second (modified) sections 32$y$, FIG. 6. The modified sections 32$y$ are generated by narrow groove sections 55$n$ in roller 52. The unmodified sections 32$x$ are allowed by receiving groove sections 55$w$ that are sufficiently wide so as not to distort portions the male member 13 received therein. The narrow sections 55$n$ are generally configured to press side arms toward the stem or rib as discussed above.

Typically and preferably the wide sections 55$w$ and narrow sections 55$n$ alternate in a manner such that generally symmetric pressing occurs. This is generated by having both the wide sections 55$w$ and the narrow sections 55$y$ being centered along a groove center line that passes through the center width of each of the wide sections 55$w$ and narrow sections 55$n$. Alternates are possible, but this is generally preferred.

In a typical operation, strip 10 would be extruded, then passed through a water bath. It can, if desired, be immediately passed into a roller arrangement as shown (or it can be stored and modified later). The roller arrangement 51*x* can be operated at line speed generally corresponding to the extrusion speed. It is not typically necessarily to heat the strip 10 for modification to occur. Indeed, the modification can be conducted even when the strip 10 has been fully cooled from extrusion, and does not have to be conducted in a line following extrusion.

Typically, the strip 10 is extruded along with a mirror image strip 01. In FIG. 5, this is shown, with strip 01 also being extruded. Strip 01 is not modified, and thus it is shown with both a female member 14 and a male member 13 received within grooves 65, 66, respectively that are sufficiently wide to no cause distortion at other.

Still referring to FIG. 5, it is noted that the particular strip 10 being modified, includes a side extension section 70 with ribs 71 thereon. This would be typical for facilitating gripping, on the consumer side. Similar ribs are shown in strip 01.

Referring to FIG. 5, it is noted that what is actually depicted as strip 10, in the cross-section shown, is a mirror image of strip 30, FIG. 3; and, strip 01 of FIG. 5, would actually correspond to strip 10, FIG. 2. However, the principles can be understood from FIG. 5.

III. Some General Observations and Summary Comments

According to the present disclosure, reclosable zipper closure arrangement useable in a reclosable bag, such as a plastic bag, is provided. The zipper closure arrangement generally comprises a first, elongate, base strip having a front side and an opposite back side. The strip includes a continuous elongate, first, male member on the front side of the first elongate base strip. The continuous elongate first male member comprises a clicking sensory indicator male strip having a central rib with a continuous peak. The continuous peak of the central rib preferably has a cross-sectional height H in extension from the back side, that does not vary by any more than 0.22 mm, typically no more than 0.2 mm along a length of extension of at least 4 cm, not including any end distortion. Preferably, side H does not vary by any more than 0.15 mm along such a length, more preferably no more than 0.1 mm along such a length and most preferably no more than 0.08 mm along such a length. Also, preferably the defined limitation and variation in height extends along a distance of at least 6 cm of the strip and most preferably continuously along the strip, disregarding any end distortion.

In a typical arrangement, the first male member has a locking arrangement (for example a side arm arrangement) comprising a plurality of alternating first and second sections, wherein in each one of the plurality of first sections, the locking arrangement (side arm arrangement) comprises at least one side arm, and typically opposite side arms, projecting away from the central rib and defining a female side hook receiver arrangement, typically comprising a hook receiver associated with each arm. The hook receivers are typically positioned between each side arm in the first elongate base strip.

Also, in each one of the plurality of second sections, the side arm arrangement generally comprises at least one side arm and typically opposite side arms that project along the rib and toward the first elongate base strip to avoid the presence of female side hook receivers between any side arm and the first elongate base strip.

In a typical arrangement, in the first sections the side arm arrangement has a maximum width W1, at a location positioned at within a distance from the first peak of no more than 50% of the height H, typically at a location no more than 45% of the height H and often at a location no more than 40% of the height H. Also, typically a side arm arrangement in each of the second sections has a maximum width, W2, at a location that is further from the peak than 50% of the height H, usually further than 55% of the height H, and often further than 60% of the height H.

In a typical arrangement, a ratio of the length of each of the first sections to a length of each of the second sections is usually at least 0.75:1 and is often not more than 1.5:1 (i.e. within the range of 0.75:1 to 1.5:1, inclusive). Typically, the length ratio is within the range of 0.9:1 to 1.3:1, inclusive. Alternatives are possible.

Typically, each of the first sections has a length within the range of 2.5-7 mm, inclusive; and, each of the second sections has a length within the range of 2.5-7 mm, inclusive. Often the length of each of the sections is within the range of 3-6 mm, inclusive.

The reclosable zipper closure arrangement of claim 1 may be provided with a first elongate base strip that is configured for a double closure, and thus includes a second closure member projecting from the front side, spaced from the first male member. Typically, when constructed in this manner, the second closure member is a continuous elongate first female member.

In a typical arrangement, the first female member will comprise a continuous recess located between first and second, opposite, hook sides. The first and second, opposite, hook sides can be configured as mirror images of one another, but in an example depicted, they are preferably not mirror images of one another.

When the continuous first male member has a side arm arrangement comprising side arms on each side of the first male member, the side arms can be positioned as mirror images of one another. However, in an example depicted, they are specifically not configured as mirror images of one another.

Also, according to the present disclosure, reclosable zipper closure arrangements for use in a reclosable plastic bag are described. The reclosable zipper closure arrangements would generally comprise a first elongate base strip that can be in accord with one or more of the characterizations above, and a second elongate base strip in sealing engagement with a first elongate base strip. Thus, a first female member on the second elongate base strip comprises a continuous recess located between first and second opposite hook sides; and, the first female member is positioned with the first male closure strip member projecting into the continuous recess. In a typical arrangement, a side arm arrangement of the first female member on the second elongate base strip is positioned with one or more hook members projecting into side hook receiver(s) in first section of the first male member; and, not projecting to any side hook receivers in second sections of the first male member, the sections alternating.

Such a reclosable zipper closure arrangement can be provided in a double track arrangement. When this is the case, it will typically will be the situation that one track is inverted relative to the other track, with respect to the direction of extension of male and female members thereof; and, only one track is provided with the clicking sensory indicator. Typically, the track provided with the clicking sensory indicator is a track positioned to be oriented toward the consumer side of the package in use.

Also according to the present invention, thermoplastic pouch or bag arrangements are described. Such arrangements generally comprise first and second side panels defining a pouch arrangement having opposite closed sides; a closed bottom end; and, an open top end. A reclosable zipper arrangement as characterized above is typically positioned secured to the first and second side panels, at a location between the panels and interior of the bag.

Also according to the present disclosure, methods of modifying the closure strip of a reclosable zipper closure arrangement for use in a reclosable plastic bag are provided. The methods generally involve modifying the closure strip so that a male member thereof will be a clicking sensory male member in accord with characteristics described above. The methods typically involve passing the continuous closure strip section, comprising a continuous male elongate closure arrangement, into a first roller groove of a roller having alternating narrow and wide sections, that would cause alternating first and second sections of the type described herein above in the male closure member. This is preferably conducted while providing a resulting male member that has a continuous peak with a height H that does not vary by any more than the preferred amounts indicated above, over a length of extension of at least 4 cm, typically over a length of extension of at least 6 cm.

Techniques are described in which the continuous closure strip section used in the method includes a first female closure member thereon, that is passed into a second groove in the roller, that does not substantially modify the first female member. Indeed, a process is described in which the roller can be part of a system that receives two continuous closure strips during operation, one of which is modified and one of which is not.

The techniques described herein include provision of a closure strip made in accord with the processes described.

There is no specific requirement that a closure strip or closure strip feature, closure arrangement, pouch, etc., include all of the features characterized herein in order to obtain some benefit according to the present disclosure. There is also no requirement that the methods and techniques described herein be applied in the specific arrangements characterized, in order to obtain some benefit.

What is claimed:

1. A recloseable zipper closure arrangement useable in a recloseable plastic bag; the zipper closure arrangement comprising:

(a) a first elongate base strip having a front side and an opposite back side; and, (b) a continuous, elongate, first male member on the front side of the first elongate base strip;

(i) the continuous, elongate, first male member comprising a clicking sensory indictor male strip having a central rib with a continuous peak;

(ii) the first male member has a side arm arrangement comprising a plurality of alternating first and second sections, wherein:

(A) in each one of the plurality of first sections, the side arm arrangement comprises at least one side arm projecting away from the central rib and defining a female side hook receiver on the central rib between each side arm and the first elongate base strip; and (B) in each one of the plurality of second sections, the side arm arrangement comprises at least one side arm projecting along the rib and toward the first elongate base strip to avoid the presence of any female side hook receiver between the at least one side arm and the first elongate base strip; and (iii) the side arm arrangement in each of the second sections having a maximum width, W2, at a location that is further from the peak than 50% of a maximum cross-sectional height H of the continuous peak.

2. A recloseable zipper closure arrangement according to claim 1 wherein:

(a) the height H, in extension from the back side, does not vary by any more than 0.2 mm along a length of extension of at least 4 cm, not including any end distortion.

3. A recloseable zipper closure arrangement according to claim 1 wherein:

(a) the height H, in extension from the back side, does not vary by any more than 0.15 mm along a length of extension of at least 4 cm, not including any end distortion.

4. A recloseable zipper closure arrangement according to claim 1 wherein:

(a) the side arm arrangement in each of the first sections has a maximum width, W1, at a location within a distance from the peak closer than the location of W2.

5. A recloseable zipper closure arrangement according to claim 4 wherein:

(a) a ratio of length of each of the first sections to a length each of the second sections is within the range of 0.75:1 to 1.5:1, inclusive.

6. A recloseable zipper closure arrangement according to claim 5 wherein:

(a) the first sections each have a length within the range of 2.5 to 7 mm; inclusive; and, (b) the second sections each have a length within the range of 2.5 to 7 mm inclusive.

7. A recloseable zipper closure arrangement according to claim 4 wherein:

(a) a ratio of length of each of the first sections to a length each of the second sections is within the range of 0.9:1 to 1.3:1, inclusive.

8. A recloseable zipper closure arrangement according to claim 1 further including:

(a) a continuous elongate first female member projecting from the front side of the first elongate base strip and spaced from the first male member.

9. A recloseable zipper closure arrangement according to claim 1 wherein:

(a) a continuous elongate first female member projects from the front side of the first elongate base strip and is spaced from the first male member; and, (b) the first female member comprises a continuous recess located between first and second, opposite, hook sides.

10. A recloseable zipper closure arrangement according to claim 9 wherein:

(a) the first and second, opposite, hook sides of the first female member are not mirror images of one another.

11. A recloseable zipper closure arrangement for use in a recloseable plastic bag; the recloseable zipper closure arrangement comprising:

(a) a first elongate base strip having a front side and an opposite back side; the first elongate base strip including:

(i) a continuous, elongate, first male member on the front side of the first elongate base strip;

(A) the continuous, elongate, first male member comprising a clicking sensory indictor male strip having a central rib with a continuous peak; and, (B) the continuous peak, of the central rib, having a maximum cross-sectional height H, in extension from the back side, that does not vary by any more than 0.2 mm along a length of extension of at least 4 cm, not including any end distortion; and, (ii) the first male member having a side arm arrangement comprising a plurality of alternating first and second sections wherein:

(A) in each one of the plurality of first sections, the side arm arrangement comprises opposite side arms projecting away from the central rib and defining female side hook receivers on opposite sides of the central rib between each side arm and the first elongate base strip; and (B) in each one of the plurality of second sections, the side arm arrangement comprises side arms projecting along the rib and toward the first elongate base strip to avoid the presence of female side hook receivers between the side arms and the first elongate base strip; and (C) the side arm arrangement in each of the second sections having a maximum width, W2, at a location that is further from the peak than 50% of the height H; and (b) a second elongate base strip having a front side and an opposite back side and having:

(i) a first female member comprising a continuous recess located between first and second, opposite, hook sides;

(A) the first female member being positioned with the first male closure member projecting into the continuous recess.

12. A recloseable zipper closure arrangement according to claim 11 wherein:

(a) the first female member is positioned with:

(i) the first and second, opposite, hook sides projecting into the female side hook receivers along the first sections of the first male member; and, (ii) the first and second, opposite, hook sides not projecting to a location between the side arms and the first elongate base strip along the second sections of the first male member.

13. A recloseable zipper closure arrangement according to claim 12 including:

(a) a second, continuous, elongate female member projecting from the front side of the first base strip and spaced from the first male member;

(i) the second female member having a central recess positioned between opposite hook members; and, (b) a second, continuous, male member projecting from the front side of the second base strip and spaced from the first female member;

(i) the second male member being positioned projecting into the recess of the first female member.

14. A recloseable zipper closure arrangement according to claim 13 wherein:

(a) the second male member includes a central rib with a continuous peak and a side arm arrangement with opposite side arms projecting away from the central rib and defining receivers on opposite sides of the central rib, each receiver being between the side arm arrangement and the second base strip.

15. A recloseable zipper closure arrangement according to claim 11 wherein:

(a) the side arm arrangement in each of the first sections has a maximum width, W1, at a location within a distance from the peak closer than the location of W2.

16. A recloseable zipper closure arrangement according to claim 15 wherein:

(a) the maximum width W1 of the side arm arrangement in each of the first sections is at a location within a distance from the peak of no more than 50% of the height H.

17. A thermoplastic pouch arrangement comprising:

(a) first and second panels defining a pouch arrangement having: opposite, closed, sides; a closed bottom end; and, an open top end; and, (b) a recloseable zipper closure arrangement positioned between the first and second panels and comprising:

(i) a first elongate base strip having a front side and an opposite back side; the first elongate base strip including:

(A) a continuous, elongate, first male member on the front side of the first elongate base strip;

(1) the continuous, elongate, first male member comprising a clicking sensory indictor male strip having a central rib with a continuous peak; and, (2) the continuous peak, of the central rib, having a maximum cross-sectional height H, in extension from the back side, that does not vary by any more than 0.2 mm along a length of extension of at least 4 cm, not including any end distortion; and, (ii) the first male member having a side arm arrangement comprising a plurality of alternating first and second sections wherein:

(A) in each one of the plurality of first sections, the side arm arrangement comprises opposite side arms projecting away from the central rib and defining female side hook receivers on opposite sides of the central rib between each side arm and the first elongate base strip; and (B) in each one of the plurality of second sections, the side arm arrangement comprises side arms projecting along the rib and toward the first elongate base strip to avoid the presence of female side hook receivers between the side arms and the first elongate base strip; and (C) the side arm arrangement in each of the second sections having a maximum width, W2, at a location that is further from the peak than 50% of the height H; and (iii) a second elongate base strip having a front side and an opposite back side and having:

(A) a first female member comprising a continuous recess located between first and second, opposite, hook sides;

(1) the first female member being positioned with the first male closure strip projecting into the continuous recess.

18. A thermoplastic pouch arrangement according to claim 17 wherein:

(a) the first female member is positioned with:

(i) the first and second, opposite, hook sides projecting into the female side hook receivers along the first sections of the first male member; and, (ii) the first and second, opposite, hook sides not projecting to a location between the side arms and the first elongate base strip along the second sections of the first male member.

19. A thermoplastic pouch arrangement according to claim 18 including:

(a) a second, continuous, elongate female member projecting from the front side of the first base strip and spaced from the first male member;

(i) the second female member having a central recess positioned between opposite hook members; and, (b) a second, continuous, male member projecting from the front side of the second base strip and spaced from the first female member;

(i) the second male member being positioned projecting into the recess of the first female member.

20. A thermoplastic pouch arrangement according to claim 17 wherein:

(a) the side arm arrangement in each of the first sections has a maximum width, W1, at a location within a distance from the peak closer than the location of W2.

21. A thermoplastic pouch arrangement according to claim 20 wherein:

(a) the maximum width W1 of the side arm arrangement in each of the first sections is at a location within a distance from the peak of no more than 50% of the height H.

22. A method of modifying a closure strip of a recloseable zipper closure arrangement for use in a recloseable plastic bag; the method comprises a step of:

(a) passing a continuous closure strip section comprising a continuous, elongate, male closure member having a continuous rib and continuous peak into a first groove of a roller while distorting the male closure member to create alternating first and second sections;

(i) in each one of the plurality of first sections, the side arm arrangement comprises opposite side arms projecting away from the central rib and defining female side hook receivers on opposite sides of the central rib between each side arm and the first elongate base strip; and, (ii) in each one of the plurality of second sections, the side arm arrangement comprises side arms projecting along the rib and toward the first elongate base strip to avoid the presence of female side hook receivers between the side arms and the first elongate base strip; and, (b) the step of passing including:

(i) passing the male closure member into a first roller groove having alternating narrow and wide sections, to generate the alternating first and second sections; and, (ii) providing a resulting male member that has a continuous peaks wherein the side arm arrangement in each of the second sections has a maximum width, W2, at a location that is further from the peak than 50% of a maximum cross-sectional height H of the continuous peak.

23. A method according to claim 22 wherein:

(a) the male member is provided with a maximum height H that does not vary by more than 0.2 mm along a length of extension of at least 4 cm.

24. A method according to claim 23 wherein:

(a) the continuous closure strip section includes a first female closure member thereon; and, (b) the step of passing including passing the first female closure member into a second groove in the roller without substantially modifying the first female member.

25. A recloseable zipper closure arrangement useable in a recloseable plastic bag; the zipper closure arrangement comprising:

(a) a first elongate base strip having a front side and an opposite back side; and (b) a continuous, elongate, first male member on the front side of the first elongate base strip;

(i) the continuous, elongate, first male member comprising a clicking sensory indictor male strip having a central rib with a continuous peak;

(ii) the first male member having a side arm arrangement comprising a plurality of alternating first and second sections, wherein:

(A) in each one of the plurality of first sections, the side arm arrangement comprises at least one side arm projecting away from the central rib and defining a female side hook receiver on the central rib between each side arm and the first elongate base strip; and (B) in each one of the plurality of second sections, the side arm arrangement comprises at least one side arm projecting along the rib and toward the first elongate base strip to avoid the presence of any female side hook receiver between the at least one side arm and the first elongate base strip;

(C) the continuous peak of the central rib has a maximum cross-sectional height H in extension from the back side;

(iii) the side arm arrangement in each of the first sections having a maximum width, W1, at a location within a distance from the peak of no more than 50% of the height H; and (iv) the side arm arrangement in each of the second sections having a maximum width, W2, at a location that is further from the peak than 50% of the height H.

26. A recloseable zipper closure arrangement according to claim 25 wherein:

(a) the height H does not vary by any more than 0.2 mm along a length of extension of at least 4 cm, not including any end distortion.

27. A recloseable zipper closure arrangement according to claim 25 wherein:

(a) a ratio of length of each of the first sections to a length each of the second sections is within the range of 0.75:1 to 1.5:1, inclusive.

28. A recloseable zipper closure arrangement according to claim 25 wherein:

(a) a ratio of length of each of the first sections to a length each of the second sections is within the range of 0.9:1 to 1.3:1, inclusive.

29. A recloseable zipper closure arrangement according to 25 including:

(a) a continuous elongate first female member projecting from the front side of the first elongate base strip and spaced from the first male member.

30. A recloseable zipper closure arrangement according to claim 29 wherein:

(a) the first female member comprises a continuous recess located between first and second, opposite, hook sides.

31. A recloseable zipper closure arrangement according to claim 30 wherein:

(a) the first and second, opposite, hook sides of the first female member are not mirror images of one another.

* * * * *